US006202331B1

(12) United States Patent
Kobayashi

(10) Patent No.: US 6,202,331 B1
(45) Date of Patent: Mar. 20, 2001

(54) ARM WITH SIMPLIFIED ATTACHMENT REMOVABLE UNIT FOR CONSTRUCTION EQUIPMENT

(75) Inventor: Takahiro Kobayashi, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/305,717

(22) Filed: May 5, 1999

(30) Foreign Application Priority Data

May 14, 1998 (JP) ..... 10-148258

(51) Int. Cl.[7] ..... E02F 3/96

(52) U.S. Cl. ..... 37/403; 37/409; 37/468; 414/723

(58) Field of Search ..... 37/468, 409, 403; 414/723; 403/322.1, 322.3

(56) References Cited

U.S. PATENT DOCUMENTS 3,935,953 * 2/1976 Stedman ..... 414/723 X
4,761,113 * 8/1988 Smith et al. ..... 414/723 X
5,915,837 * 6/1999 Brown et al. ..... 37/468

FOREIGN PATENT DOCUMENTS 56-52232 * 10/1987 (JP) ..... 37/468
62-233347 * 10/1987 (JP) ..... 37/468
6-264466 9/1994 (JP) .
2782394 5/1998 (JP) .
10-195913 7/1998 (JP) .

* cited by examiner

*Primary Examiner*—H. Shackelford
(74) *Attorney, Agent, or Firm*—Sughrue, Mion, Zinn, Macpeak & Seas, PLLC

(57) ABSTRACT

In an arm with an attachment removable unit, a reinforcing plate 14 is provided in a space between a pair of bracket portions 12, 12 which are formed by extending the opposite side walls of an arm so as to protrude from the upper and lower walls thereof. An attachment removable unit 100 is housed in the space between the of bracket portions 12, 12. In the state where the attachment 2 is attached to the arm 1, a second hook 7 for engaging a second pin 17 for coupling with the attachment 2 is disposed on a substantially straight line connecting between a pin 19 for connecting with the arm 1 and a first hook 6 for engaging a first pin 18 for connecting with the attachment 2.

5 Claims, 4 Drawing Sheets

ARM WITH SIMPLIFIED ATTACHMENT REMOVABLE UNIT FOR CONSTRUCTION EQUIPMENT

BACKGROUND OF THE INVENTION

1. Field of the Invention

The present invention relates to an arm with an attachment removable unit capable of easily removing an attachment from an arm of a construction equipment and, more particularly, relates to an arm with an attachment removable unit capable of easily removing an attachment from an arm while maintaining the performance of a front portion such as a hydraulic shovel or excavator, a tractor shovel, or the like.

2. Description of the Related Art

In general, a construction equipment, for example, a hydraulic shovel, a tractor shovel, or the like, is provided at its main body of a work vehicle with at least an arm as a member forming a front portion thereof and also provided at the tip portion of the arm with a bucket, for example, as an attachment so as to be operable for various works. The attachment is exchanged for a new one such as a normal excavating bucket, a bucket with a wide width, a bucket for forming a normal plane, a breaker for breaking the road surface or a rock, a ripper, or the like, in accordance with the kind, contents or state of the work. In the case of performing such an exchanging operation of an attachment, it is necessary to align the hole for a pin at the tip portion of the arm with the hole for a pin of the attachment and then draw or insert the pin, so that at least two workers are required. Since much time and many workers are required for such an exchanging operation of the attachment, there has been proposed an attachment removable unit for performing the attachment exchanging operation efficiently. There is a technique (hereinafter called a prior art) disclosed in JP-A-6-264466 as an example of such a kind of conventional attachment removable unit.

An attachment removable unit 101 according to such a prior art includes as shown in FIGS. 7 and 8 a main frame 9 having at one of its opposite ends a boss 15 into which a coupling pin 19 at the tip end side of an arm 1 is pressed and also having at the other of the opposite ends a boss 16 into which a pin 21 for coupling a link 3 is pressed. The attachment removable unit 101 further includes a first hook 6 for engaging with one coupling pin (hereinafter called a first pin) 18 of a bucket 2 and a second hook 7 for engaging with the other coupling pin (hereinafter called a second pin) 17 of the bucket 2. The bosses 15, 16 and the first and second hooks 6, 7 are disposed in a manner that a line a1–a2 connecting the center portions of the bosses 15, 16 is substantially in parallel to a line b1–b2 connecting the first and second hooks 6, 7 with a distance L therebetween. Further, a hydraulic cylinder 20 is provided in order to adjust the distance between the first pin 18 and the second pin 17.

The attachment removable unit 101 according to the thus arranged prior art is attached to an arm 1' in a manner that a pair of the main frames 9 are disposed so as to sandwich the arm 1' shown in FIG. 6 therebetween from the outside of the opposite side walls of the arm 1', then the pin 19 for coupling the arm 1' is pressed into the boss 15, and the pin 21 for coupling the link 3 is pressed into the boss 16.

In this state, the bucket 2 serving as an attachment is attached to the arm in a manner that the second hook 7 is hung at the second pin 17 on the bucket 2 side and the first hook 6 is hung at the first pin 18 on the bucket 2 side, and then these pins are engaged with the hooks by applying a predetermined pressing force by means of the hydraulic cylinder 20.

Accordingly, according to the prior art, since the attachment can be easily exchanged, the aforesaid problem relating to the time and workers for the attachment exchanging operation can be eliminated.

Although the above-described prior art is able to obviate the conventional problem relating to the time and workers for the attachment exchanging operation in this manner, there arises the following new problem in the aforesaid prior art due to the structure of the attachment removable unit and the structure of the arm.

That is, in the aforesaid prior art, the distance from the rotation fulcrum (the center portion of the coupling pin 19) on the arm 1' side to the tip end of the bucket 2 becomes longer by the distance L between the aforesaid line a1–a2 and the line b1–b2, so that the rotation range of the bucket 2 becomes longer as compared with the case where the attachment removable unit 101 is not provided. Thus, in the state where an attachment hydraulic cylinder 5 is fully extended, the tip portion of the bucket 2 may contact with the lower plate of the arm 1', or, although not shown, the tip portion of the bucket 2 may interfere with the main body of the hydraulic shovel depending on the posture of the boom and the arm 1' of the hydraulic shovel, for example. Further, since the maximum driving force of the attachment hydraulic cylinder 5 is a predetermined value irrespective of the presence or not-presence of the attachment removable unit 101, the excavation force decreases by an amount corresponding to the increased distance of the rotation distance from the rotation fulcrum to the tip end of the bucket 2 due to the presence of the attachment removable unit.

SUMMARY OF THE INVENTION

The present invention has been made in view of the aforesaid problem of the prior art and an object of the present invention is to provide an arm with an attachment removable unit for a construction equipment capable of easily performing an attachment removing operation with scarcely changing the distance from the rotation fulcrum on the arm side to the tip end of the attachment.

In order to achieve the aforesaid object, the invention according to claim 1 of the present invention is characterized in that in an arm with an attachment removable unit which is provided in a construction equipment having at least an arm and an attachment which is attached to the arm through the attachment removable unit, the attachment removable unit is arranged in a manner that, in a state where the attachment is attached to the arm, a second hook for engaging a second pin for coupling with the attachment is disposed on a substantially straight line connecting a hole for a pin for connecting with the arm and a first hook for engaging a first pin for connecting with the attachment.

Since the arm with an attachment removable unit according to the present invention is arranged in the aforesaid manner, the attachment can be exchanged easily by merely engaging the first hook with the first pin for coupling the attachment and by engaging the second hook with the second pin for coupling the attachment. In the state where the attachment is coupled to the arm, the respective connection portions are disposed on a substantially straight line through the attachment removable unit. Further, the arm connection portion (hole portion for a pin) of the attachment removable unit is disposed in the vicinity of one connection portion (the first pin portion) for the attachment of the attachment removable unit. Accordingly, the distance from the center portion of the hole for a pin serving as the rotation center of the attachment to the tip end of the attachment can be substantially same as that in the case where the attachment is directly coupled to the arm without intervening the attachment removable unit. As a consequence, the tip portion of the attachment is prevented from interfering with other portions of the construction equipment and further the excavation force of the attachment can be maintained.

DETAILED DESCRIPTION OF THE PREFERRED EMBODIMENTS

Figure 7:
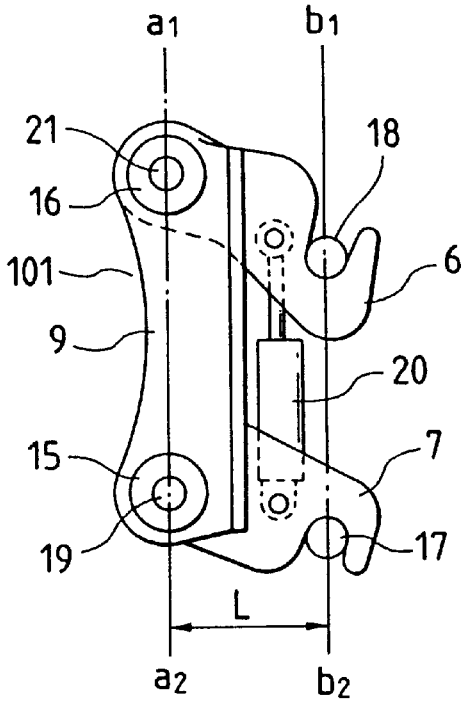
FIG. 7 PRIOR ART
FIG. 7 is a side view showing a conventional attachment removable unit.
Figure 8:
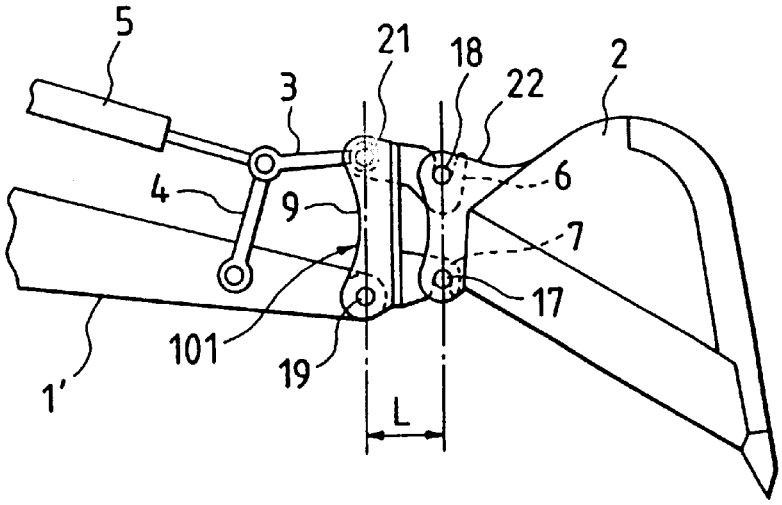
FIG. 8 PRIOR ART
FIG. 8 is a side view showing a state where an attachment is mounted by using the attachment removable unit according to the prior art.

An embodiment of the present invention will be described with reference to the accompanying drawings. FIGS. 1 to 5 are diagrams for explaining the embodiment of the present invention. In FIGS. 1 to 5, parts identical with those of FIGS. 7 and 8 used for explaining the prior art are labeled with the same symbols and explanation thereof will be omitted.

Figure 1:
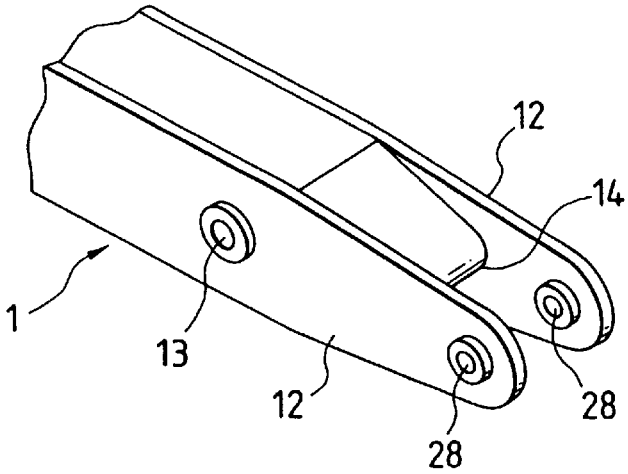
FIG. 1 is a perspective view showing an arm according to an embodiment of the present invention.

As shown in FIG. 1, an arm 1 with an attachment removable unit (hereinafter called an arm) according to the embodiment is formed by four walls, that is, upper and lower walls and left and right side walls. The left and right side walls of the arm 1 is extended so as to protrude from the end portions of the upper and lower walls to form a pair of bracket portions 12. In the vicinity of the tip portions of the pair of bracket portions 12, bosses 28 having holes for a pin are provided into which a coupling pin 19 for coupling the attachment removal unit 100 is inserted with pressure. Further, a reinforcing plate 14 is provided at the rear portions of the bosses 28 so as to extend between both the bracket portions 12. Furthermore, at the rear portions of the reinforcing plate 14, bosses 13 (only one of these bosses is shown in FIG. 1) having holes for a pin are provided so as to pivotally support a link 4 shown in FIG. 3 by a pin 26 inserted into the holes.

Figure 2:
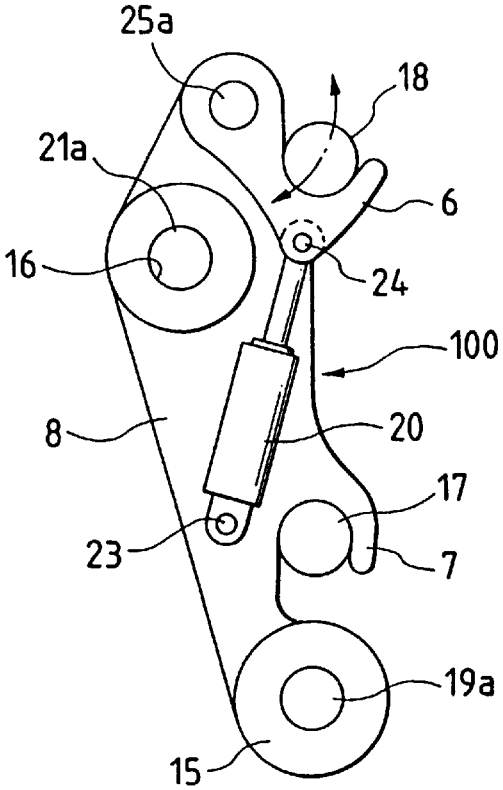
FIG. 2 is a diagram showing a side view of an attachment removable unit according to the embodiment of the present invention.

The structure of the attachment removal unit 100 will be explained with reference to FIG. 2. As shown in FIG. 2, the attachment removal unit 100 includes, at the one end side of a main frame 8, a boss 15 having a hole 19*a* for a pin for coupling with the arm 1 through the coupling pin 19, and a boss 16 having a hole 21*a* for a pin for coupling with a link 3 through a pin 21. Further, the attachment removal unit 100 is provided with a first hook 6 and a second hook 7 for coupling with a bucket 2, for example, serving as an attachment. The second hook 7 is integrally formed with the main frame 8 at the position satisfying such a positional relation with respect to the boss 15 that the attachment does not interfere with the boss 15 to each other in the state where the attachment is coupled with the attachment removal unit. The first hook 6 is mounted to the main frame 8 through a pin 25 so as to be rotatable with respect to the main frame 8 around the pin 25 inserted into a hole 25*a* for a pin. The one end of a hydraulic cylinder 20 is mounted to the main frame 8 through a pin 23 and the other end thereof is mounted to the first hook 6 through a pin 24, whereby the first hook 6 rotates in accordance with the expansion and contraction of the hydraulic cylinder 20. According to the embodiment, in the state where the attachment is coupled to the arm through the attachment removal unit, the second hook 7 is disposed on a substantially-straight line connecting between the hole 19*a* for a pin of the boss 15 and the first hook 6, as shown in FIGS. 3 and 4.

Figure 3:
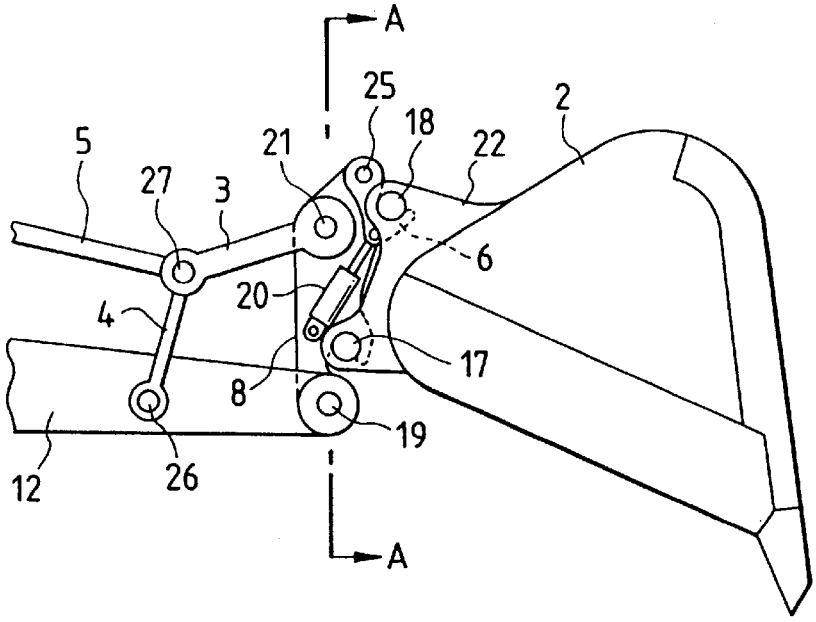
FIG. 3 is a side view showing a state where an attachment is coupled to an arm through the attachment removable unit according to the embodiment of the present invention.
Figure 4:
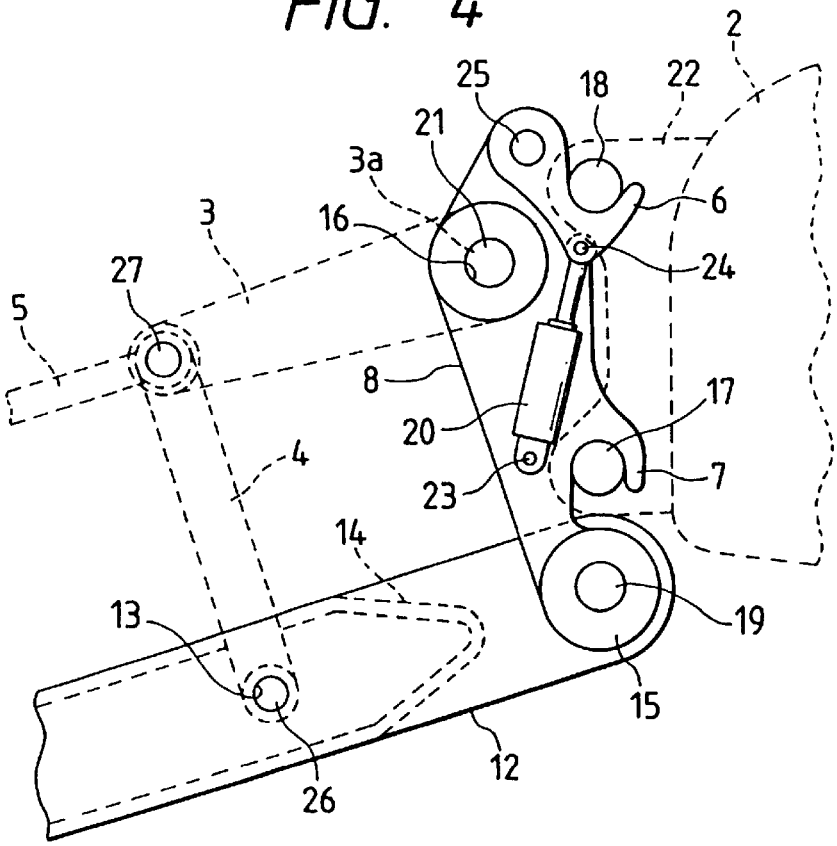
FIG. 4 is an enlarged diagram showing the vicinity of the respective connection portions in FIG. 3.
Figure 5:
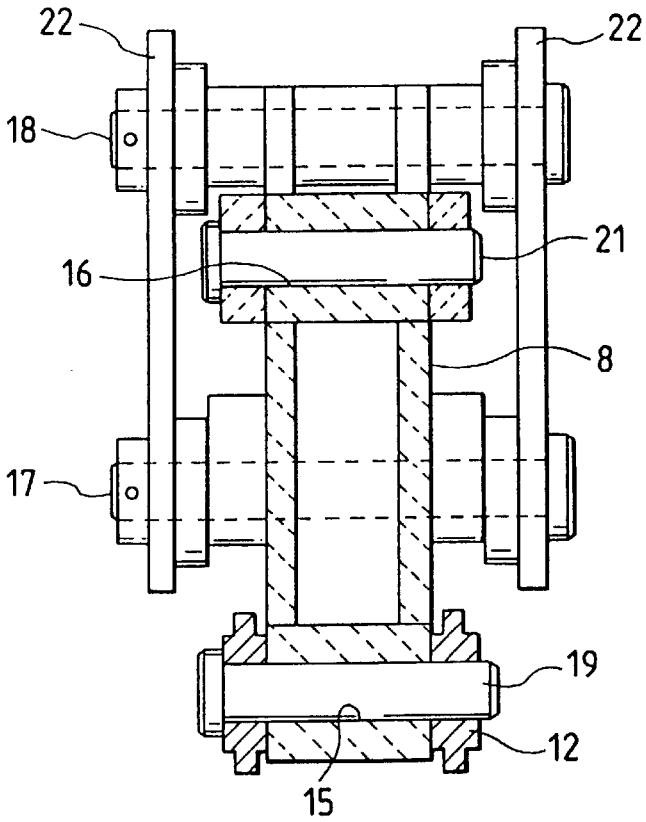
FIG. 5 is a sectional view taken along a line A—A in FIG. 3.

As shown in FIGS. 3 to 5, the attachment removal unit 100 is coupled to the arm 1 in a manner that the attachment removal unit 100 is set between the pair of the bracket portions 12, and then the coupling pin 19 is inserted into the holes of the bosses 28 and 25 in a state that the center portions of the bosses 28 at the vicinity of the tip portion of the arm 1 are aligned with the center portion of the boss 15 of the attachment removal unit 100. The link 3 for transmitting the driving force of a hydraulic cylinder 5 for the attachment to the bucket 2 is also coupled to the unit by inserting the pin 21 into the holes of the bosses 3*a* and 16 in such a state that the center portion of the boss 16 is aligned with the center portions of the bosses 3*a* on the link 3 side.

The links 3 and 4 are provided generally for a hydraulic shovel. These links are members forming a parallel link mechanism for transmitting the driving force of the hydraulic cylinder 5 for the attachment to the bucket 2, and coupled to the rod portion of the hydraulic cylinder 5 by means of a pin 27.

Since the arm with an attachment according to the embodiment is arranged in the aforesaid manner, the bucket 2 is coupled to the arm in the following manner. That is, first, as shown in FIGS. 3 to 5, the second hook 7 is hung at the second pin 17 for connection which is pressed into the space between the pair of brackets 22 provided at the rear wall of the bucket 2, and then the first hook 6 is hung at the first pin 18 which is likewise pressed into the space between those brackets 22. When the hydraulic cylinder 20 is extended in this state, the first hook 6 pivotally supported by the pin 25 rotates so that the second pin 17 and the first pin 18 are surely engaged with and stopped by the second hook 7 and the first hook 6, respectively.

As described above, since the second hook 7 is disposed in the vicinity of the boss 15, the distance from the center of the coupling pin 19 serving as the rotation fulcrum of the bucket 2 to the tip portion of the bucket 2 is substantially the same as that in the case where the bucket is directly coupled to the arm without the attachment removal unit 100 intervening therebetween. Further, in the state where the bucket 2 is coupled to the arm, since the hole 19*a* for a pin of the boss 15 and the second and first hooks 7 and 6 are disposed on a substantially straight line, the rotation range of the bucket 2 in accordance with the expansion and contraction of the hydraulic cylinder 5 for an attachment is substantially the same as that in the case where the bucket is directly coupled to the arm without intervening of the attachment removal unit 100.

Figure 6:
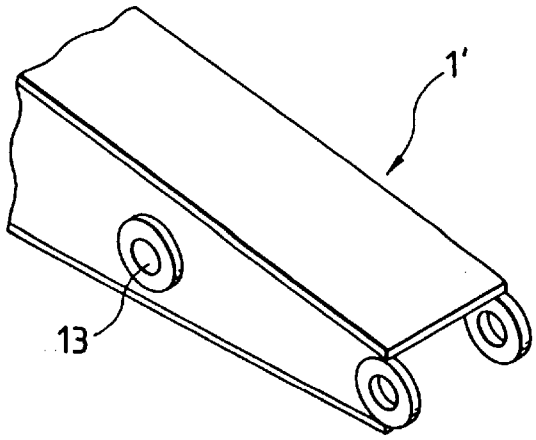
FIG. 6 PRIOR ART
FIG. 6 is a perspective view showing a conventional arm.

Since the arm with an attachment removable unit according to the embodiment is arranged in such a manner that the bracket portions 12 are provided at the opposite side walls of the tip portion of the arm 1 and the attachment removal unit 100 is disposed between the bracket portions 12, it is easy to arrange the hole 19*a* for a pin of the boss 15 and the second and first hooks 7 and 6 on a substantially straight line and to dispose the second hook 7 in the vicinity of the boss 15. In the conventional arm 1' shown in FIG. 6, the boss into which the coupling pin 19 is pressed is provided at the tip portion of the arm. Thus, in the case of coupling the bucket 2 to the arm through the attachment removal unit 100, it is necessary to separate the boss of the attachment removable unit from the hook with a certain distance in order to prevent the interference between the bucket 2 and the boss or the surface of the main frame 9. In contrast, according to the embodiment of the present invention, since the space for receiving the attachment removal unit 100 is provided between the bracket portions 12, the aforesaid interference can be easily prevented.

Although in the aforesaid embodiment, the explanation is made on the case where the bucket 2 is employed as an example of the attachment, another member such as a breaker, a ripper or the like may be employed as the attachment.

As described above, according to the arm with an attachment removable unit of the embodiment, the removing operation of the attachment can be performed easily. Further, the distance from the rotation fulcrum (the center position of the coupling pin 19) on the arm 1 side to the tip end of the bucket 2 and the rotation range of the bucket 2 can be made substantially same as that in the case where the bucket 2 is directly coupled to the arm 1. Accordingly, the tip portion of the bucket 2 is prevented from interfering with other portions of the hydraulic shovel and further the reduction of the excavation force can be prevented.

As described above, according to the present invention, the removing operation of the attachment can be performed easily. Further, the distance from the rotation fulcrum on the arm side to the tip end of the attachment can be substantially same as that in the case where the attachment is coupled to the arm without intervening the attachment removable unit. Accordingly, the tip portion of the attachment is prevented from interfering with other portions of the hydraulic shovel and further the reduction of the excavation force of the attachment can be prevented.

What is claimed is:

1. An arm with an attachment removable unit which is provided in a construction equipment having at least an arm and an attachment which is attached to the arm through the attachment removable unit, said attachment including a first and second pin, said attachment removable unit comprising:

a pin hole portion for connecting said attachment removable unit with said arm;

a first hook for engaging said first pin; and a second hook for engaging said second pin;

wherein in a state where said attachment is attached to said arm, said second hook is disposed on a substantially straight line connecting said pin hole portion and said first hook; and wherein said second hook is disposed between said pin hole portion and said first hook.

2. An arm with an attachment removable unit which is provided in a construction equipment having at least an arm and an attachment which is attached to the arm through the attachment removable unit, said attachment including a first and second pin, said attachment removable unit comprising:

a pin hole portion for connecting said attachment removable unit with said arm;

a first hook for engaging said first pin; and a second hook for engaging said second pin;

wherein in a state where said attachment is attached to said arm, said second hook is disposed on a substantially straight line connecting said pin hole portion and said first hook, wherein a center portion of said pin hole portion is disposed in a vicinity of a center portion of said second hook to such a degree that a pin for connecting with said arm does not interfere with said attachment, and wherein a pair of bracket portions are formed at a tip portion of said arm by extending opposite side walls of said arm so as to protrude from upper and lower walls thereof, and said attachment removable unit is disposed between said bracket portions.

3. An arm with an attachment removable unit according to claim 2, wherein pin holes for attaching said attachment removable unit are provided in a vicinity of tip portions of said pair of bracket portions, respectively, and a reinforcing plate is provided at rear portions of said holes for a pin so as to extend between said pair of bracket portions.

4. An arm with an attachment removable unit according to claim 1, wherein said attachment is a bucket.

5. An arm with an attachment removable unit according to claim 2, wherein said construction equipment is a hydraulic shovel having a boom and said arm.

* * * * *